United States Patent [19]

Bartilucci et al.

[11] Patent Number: 4,874,505

[45] Date of Patent: Oct. 17, 1989

[54] RECYCLE OF OILY REFINERY WASTES

[75] Inventors: Mark P. Bartilucci, Clementon; Grant G. Karsner, Voorhees Township, Camden County; William J. Tracy, III, Sewell, all of N.J.

[73] Assignee: Mobil Oil Corporation, New York, N.Y.

[21] Appl. No.: 151,380

[22] Filed: Feb. 2, 1988

[51] Int. Cl.[4] ..... C10G 9/14; C10G 17/00

[52] U.S. Cl. ..... 208/131; 208/50; 201/2.5

[58] Field of Search ..... 208/131, 127, 48 G, 208/50; 201/2.5, 39, 40, 25; 210/21, 40

[56] References Cited

U.S. PATENT DOCUMENTS

| | | | |
|---|---|---|---|
| 3,116,231 | 12/1963 | Adee | 208/46 |
| 3,146,185 | 8/1964 | Fella | 208/48 |
| 3,451,921 | 6/1969 | Janes | 208/46 |
| 3,716,474 | 2/1973 | Hess | 208/13 |
| 3,759,822 | 9/1973 | Folkins | 208/131 |
| 3,876,538 | 4/1975 | Hess et al. | 210/21 |
| 3,917,564 | 11/1975 | Meyers | 208/131 |
| 4,014,661 | 3/1977 | Hess | 201/2.5 |
| 4,030,981 | 6/1977 | Hess et al. | 201/2.5 |
| 4,102,749 | 7/1978 | Hess et al. | 201/2.5 |
| 4,118,281 | 10/1978 | Yan | 208/2.5 |
| 4,259,178 | 3/1981 | Wynne | 208/131 |
| 4,370,223 | 1/1983 | Bose | 208/125 |
| 4,552,649 | 11/1985 | Patterson et al. | 208/127 |
| 4,666,585 | 5/1987 | Figgins | 208/131 |

*Primary Examiner*—Glenn Caldarola

*Attorney, Agent, or Firm*—Alexander J. McKillop; Charles J. Speciale; Malcolm D. Keen

[57] ABSTRACT

Petroleum refinery waste stream sludges are recycled by segregating the sludges according to their oil content. Sludges of high oil content are injected into a delayed coking unit during the coking phase so that they are converted to coke and liquid coking products. High water content sludges are used to quench the coke during the quench phase of the coking cycle, with minimal increases in coke volatile matter. The process increases the capacity of the delayed coking unit to process and recycle refinery waste sludges and produce a coke of lower volatile content.

13 Claims, 1 Drawing Sheet

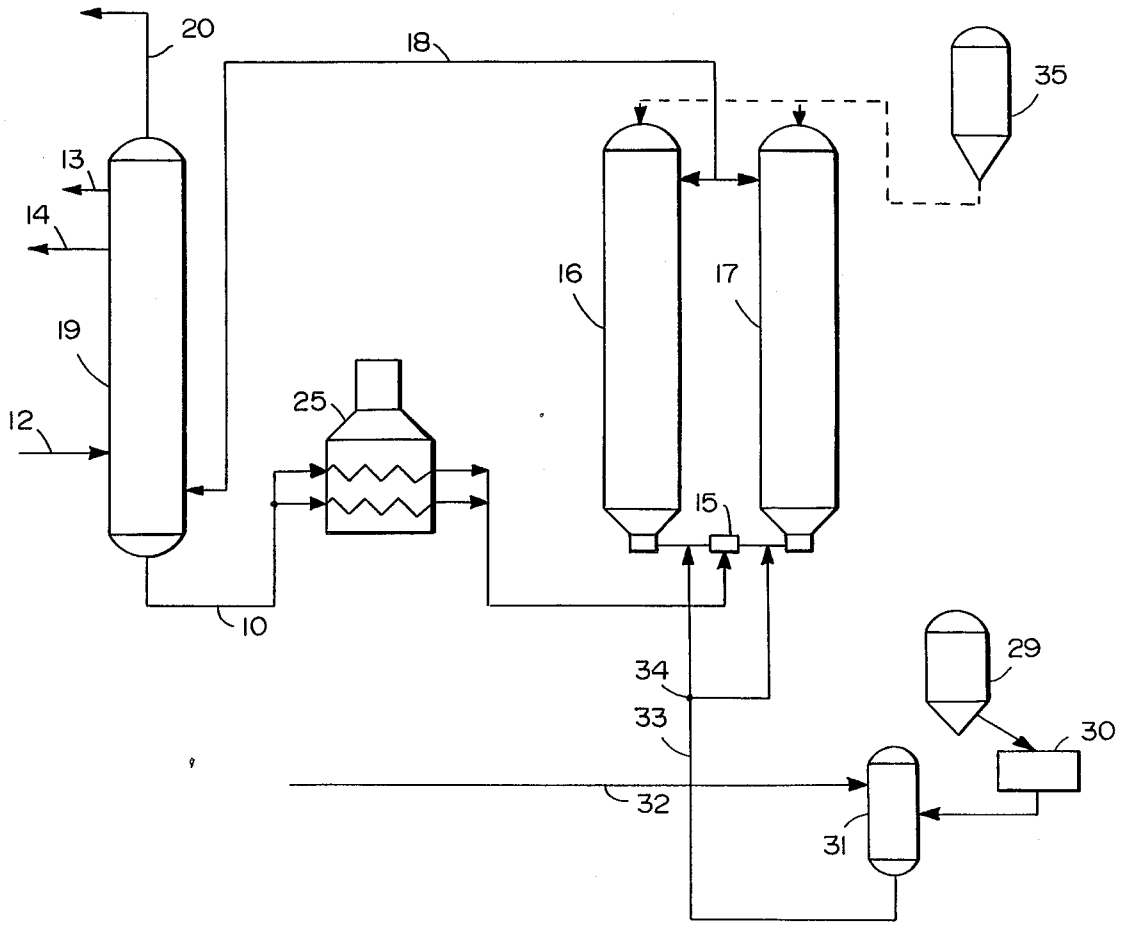
35
29
30
31
17
15
34
33
32
16
18
25
10
20
13
14
19
12

RECYCLE OF OILY REFINERY WASTES

FIELD OF THE INVENTION

This invention relates to a method of recycling waste products from petroleum refineries, especially oily sludges produced during various petroleum refining processes. In particular, the invention relates to a process for recycling petroleum refinery sludges using a delayed coker unit.

BACKGROUND OF THE INVENTION

Waste products are produced during the refining of petroleum, for example, heavy oily sludges, biological sludges from waste water treatment plants, activated sludges, gravity separator bottoms, storage tank bottoms, oil emulsion solids including slop oil emulsion solids or dissolved air flotation (DAF) float from floculation separation processes. Waste products such as these may create significant environmental problems because they are usually extremely difficult to convert into more valuable, useful or innocuous products. In general, they are usually not readily susceptible to emulsion breaking techniques and incineration which requires the removal of the substantial amounts of water typically present in these sludges would require elaborate and expensive equipment. For this reason, they have often been disposed of in the past by the technique known as "land farming" by which the sludge is worked into the land to permit degradation by bacterial action. Resort to these methods has, however, become more limited in recent years with increasingly stringent environmental controls and increases in the amount of such waste products produced in refineries. In particular, the use of land farming is likely to encounter more stringent regulation in the future because of the potential for pollution, both of ground water and the air.

A process for disposing of petroleum refinery sludges and other wastes is disclosed in U.S. Pat. No. 3,917,564 (Meyers) and this process has been shown to be extremely useful. In it, sludges or other by-products of industrial and other community activity are added to a delayed coker as an aqueous quench medium during the quench portion of the delayed coking cycle. The combustible solid portions of the byproduct become a part of the coke and the non-combustible solids are distributed throughout the mass of the coke so that the increase in the ash content of the coke is within commercial specifications, especially for fuel grade coke products. As shown in U.S. Pat. No. 3,917,564, sludges which may be treated by this method include petroleum refinery slop emulsions, biological sludges and sludges containing large amounts of used catalytic cracking catalyst mixed with biological wastes.

Another proposal for dealing with petroleum sludges is disclosed in U.S. Pat. No. 4,666,585 (Figgins) which discloses a process in which petroleum sludges are recycled by adding them to the feedstock to a delayed coker before the quenching cycle so that the sludge, together with the feed, is subjected to delayed coking. This process has the desirable aspect of subjecting the combustible portion of the sludge to the high coking temperatures so that conversion either to coke or to cracked hydrocarbon products, takes place. However, the presence of water in the sludge tends to lower the coking temperature unless compensation is made for this factor, for example, by increasing the operating temperature of the furnace and this may decrease the yield of the more desirable liquid products from the delayed coking process. In addition, the amount of sludge which may be added to the coker feed is limited by the presence of the relatively large amounts of water in the sludge. As described in the patent, the amount of sludge is limited to 0.01 to 2 weight percent.

SUMMARY OF THE INVENTION

An improved process for the recycling of sludges has now been developed which permits significantly larger quantities of sludges to be processed with refinery stream in a delayed coking unit. During the processing, the combustible portion of the sludge is converted by coking to coke and lower molecular weight liquid products which may be recovered in the product recovery unit associated with the coker.

According to the present invention the process in which oily sludges and other refinery waste streams are recycled operates by segregating refinery or other sludges into a high oil content waste which is injected into a delayed coking unit during the coking phase of the cycle and a high water content waste which is injected during the quenching phase of the delayed coking cycle. This process increases the capacity of the delayed coker to process these refinery wastes and sludges and has the potential for improving the quality of the resulting coke obtained from the process. It has the particular advantage that the amount of sludge which may be added to the coker feed for recycling is increased.

BRIEF DESCRIPTION OF THE DRAWINGS

The single FIGURE of the accompanying drawings is a schematic flow diagram showing a delayed coking unit in which the present process may be carried out.

DETAILED DESCRIPTION

The present process for recycling petroleum waste streams and other waste products obtained from industrial or community activity is particularly useful for recycling the sludges which are encountered during petroleum refining operations. It is therefore of especial utility for recycling oily sludges, including sludges defined as "solid wastes" by the Environmental Protection Administration. However, it may be employed with a wide range of waste products including biological sludges from waste water treatment plants, such as activated sludges, and other oily sludges including gravity separator bottoms, storage tank bottoms, oil emulsion solids including slop oil emulsion solids, finely dispersed solids or dissolved air flotation (DAF) float from floculation separating processes and other oily waste products from refinery operations. Sludges of this kind are typically mixtures of water, oil, suspended carbonaceous matter together with varying quantities of non-combustible material, including silt, sand, rust, catalyst fines and other materials. These sludges are typically produced in the course of refining operations including thermal and catalytic cracking processes and from heat exchanger and storage tank cleaning and in the bottoms of various process units including the API separator.

In the present process, sludges such as these are segregated according to their water content and are then recycled using a petroleum refinery delayed coking unit. The delayed coking process is an established process in the refining industry and is described, for example, in U.S. Pat. Nos. 3,917,564 and 4,666,585, to which reference is made for a disclosure of the delayed coking process and of its use in sludge recovery. In a typical delayed coking process, a petroleum fraction feed is heated by direct heat exchange with the cracking products in a combination tower in which any light components in the feed are removed by contact with the hot, vaporous cracking products. The feed then passes to the furnace where it is brought to the temperature requisite for the delayed coking process to proceed, typically to temperatures from 700° to about 1100° F. (about 370° to about 595° C.). The heated feed is then fed into a large delayed coking drum under conditions which permit thermal cracking to take place. As the coking drum fills, cracking occurs and lighter constituents of the cracking are removed as vaporous cracking products while condensation and polymerization of aromatic structures takes place, depositing a porous coke mass in the drum which is removed when the drum is full. In a conventional delayed coking unit, two or more coke drums are used in sequence with the feed being fed to each drum in turn during the coking phase of the cycle until the drum is substantially full of coke. The feed is then switched to the next coking drum in the sequence while the first drum is stripped of volatile cracking products by the use of steam, after which the coke is quenched during the quenching phase of the delayed coking cycle and then removed from the coking drum, usually by use of hydraulic cutting equipment.

In the present sludge recycling process, the coking feed, typically comprising a heavy petroleum feedstock e.g. a residual feed, is combined with sludge of relatively high oil content (and, conversely, of relatively low water content) during the coking phase of the delayed coking cycle and subjected to coking conditions to produce cracking products and coke. During the quench phase of the delayed coking cycle sludge of relatively high water content (and, conversely, of relatively lower oil content) is injected into the coker drum to quench the coke, after which it may be removed from the coker drum in the normal way. Initially, therefore, the waste sludges are segregated into a sludge of high oil content and a second sludge of high water content. The sludges may be collected separated from various refinery process units according to their water content and stored in separate tanks until they are withdrawn with the high oil content sludge being introduced into the delayed coker with the heavy coking feed and the higher water content sludge injected into the drum during the quench phase of the cycle. In this way, the characteristics of the sludge are matched to the two phases of the delayed coking cycle so as to obtain the best conditions for the effective recycling of the sludges. The high oil content sludge is subjected to the delayed coking conditions so that the oil in the sludge is effectively converted to coke and more valuable, cracked products and the high water content sludge is used during the quench phase of the cycle when it is highly effective as a quench medium. The coking phase of the cycle is therefore carried out with relatively less water and because of this, the conditions during the coking phase of the cycle may be maintained at more optimal values, with a consequent improvement in coke product quality. Similarly, the relatively lower oil content of the sludge which is added during the quench portion of the coking cycle reduces the amount of volatile combustible material (VCM) in the coke product. Thus, an optimized recycling process is achieved in this way.

Typically, the sludges will be segregated into sludges of relatively high oil content, usually implying a water content of less than 60 to 70 weight percent typically with 10 to 25 weight percent oil and high water content sludges, typically implying a water content greater than 50 wt% and more usually greater than 60 or 70 wt%. The use of high water content sludges with water contents of at least 85% is preferred for the quenching step since the water provides good quenching while the low residual oil content ensures that the VCM content of the product coke is maintained at a low value. Table 1 below shows typical compositions of some common petroleum refinery waste steams. Streams such as the DAF float and biosludge tend to have higher water contents while slop oil emulsions usually have high oil contents, as shown in the Table.

TABLE 1

| | Composition (Wt %) | | |
|---|---|---|---|
| | Water | Oil | Solids |
| Slop Oil Emulsion Solids | 40–65 | 15–25 | 15–40 |
| DAF Float | 70–95 | 5–15 | 10–20 |
| Biosludge | 85–95 | 0 | 5–15 |
| API Separator Bottoms | 55–70 | 10–20 | 15–25 |

In order to optimize conditions during the coking it is preferred to increase the oil content of the sludge which is injected during this phase, typically from 10–25 weight percent to at least 50 weight percent or even higher e.g. 60, 70 or 85 weight percent. This may be achieved by subjecting the oily sludge to an initial dewatering step by heating and flashing in a conventional vapor/liquid separator. After removal from the separator, the dewatered sludge, typically with less than 50 weight percent water, may be added directly to the coking feed from the coking furnace, for example, at a point between the furnace and the delayed coking drum or directly into the drum. However, alternative sequences may be employed, for example, the cold sludge may be injected directly into the delayed coking drum or it may be combined with the coking feed before or after the furnace. It is generally preferred to add the oily sludge after the furnace in order to decrease furnace coking.

All or a portion of the oily sludge may be preheated prior to being introduced into the delayed coker unit, for example, to increase fluidity or maintain the desired drum inlet temperature, typically to a temperature of at least 180° F. (about 80° C.). If a dewatering step is used, it is preferred to mix the sludge with a hydrocarbon liquid after dewatering in order to increase the flowability of the sludge. Refinery streams such as coker heavy gas oil (CHGO), FCC clarified slurry oil (CSO) or heavy refinery slop oil may be used for this purpose. In most cases, the mixture of coking feed and oily sludge will be introduced into the coke drum at temperatures between about 780° and about 950° F. (415° to 510° C.), usually between 780° and 850° F. (about 415° to 455° C.).

During the coking phase of the delayed coking cycle, the carbonaceous content of the high oil content sludge is converted together with the feed by thermal cracking into coke and vaporous cracking products which are recovered in the fractionator connected to the delayed coke drum in the product recovery section of the unit.

In this way, the oily sludge is effectively recycled and converted to useful products.

The high water content sludges are used during the quench phase of the delayed coking cycle by being fed directly into the coke drum to act as quench for the hot coke in the drum. The introduction of the high water content sludge into the drum may be employed in addition to or instead of the steam or water typically used for quenching the coke. The high water content sludges act as effective quenching media and their relatively low oil content ensures that the volatile combustible matter (VCM) content of the coke product is held at an acceptable low level.

By injecting the sludges of differing water content at different stages of the coking cycle, a greater total amount of sludge may be recycled than would be the case if attempts were made to inject all the sludge at one time. The amount of oily sludge which can be tolerated during the coking phase will, of course, depend upon the general operating conditions of the coker (feed, temperature, furnace capacity) as well as sludge characteristics (solids content especially metals, water content) and the desired coke product characteristics, especially metal content; such as pretreatment conditions such as dewatering and addition of oils also affect the amount of sludge which can be added. Typically, oily refinery sludges can be added at a rate of at least 0.5 bbl/ton coke product during the coking phase with additional high water content sludge injected during quenching to give a total recycling capacity of at least 1 bbl/ton coke or even higher e.g. 1.5 or 2 bbl/ton coke produced. Furthermore, the coke will have low VCM since the oily sludge components are coked together with the feed during the coking phase of the cycle. Increases in VCM below 1 weight percent e.g. 0.5 weight percent may be obtainable. In favorable cases, electrode grade coke may be produced whilst retaining a significant sludge recycling capacity.

A wide variety of petroleum refinery sludges and other waste products resulting from industrial and community activities may be effectively recycled in the delayed coking unit in a way which permits unit operating conditions to be optimized so as to produce a valuable product whilst handling and recovering these waste products in an environmentally sound and acceptable manner. Segregation of the sludges followed by sequenced injection as described above increases the capacity of the delayed coker to process these waste products: the temperature drop associated with the injection of sludge during the coking phase is reduced by limiting the quantity of water introduced into the coke drum. Conversely, the VCM content of the coke product is reduced by limiting the quantity of oil which is introduced to the coke drum at the reduced temperatures associated with the quench phase of the cycle. Although the exact values of the oil and water contents of the sludges at the times they are injected into the coker drums is not critical, the best results will clearly be obtained when the sludge injected during the coking phase has a high oil content and, conversely, a low water content, while the sludge used for quenching should have a relatively high water content and a correspondingly low oil content. Thus, the process objective is to use sludges of differing oil/water quenching phases of the delayed coking cycle: the oil/water ratio of the sludge which is subjected to coking in the drum is to be higher than that of the sludge used for quenching after coking has been completed.

A preferred mode of operation is illustrated in the FIGURE. Delayed coker drums 16 and 17 are arranged so that feed may be directed to either or both of them through valve 15. Vaporous products pass through conduit 18 to combination tower 19 for making the appropriate product cuts, for example, with coker gasoline and gas oil exiting conduits 13 and 14 and gas through line 20. Fresh coker feed enters the tower through inlet 12. The bottoms fraction comprising unvaporized feed and unconverted coking products passes through conduit 10 to heater 25 and then to coke drums 16 and 17 where it is coked.

A source of refinery waste sludge, segregated according to its oil and water contents, is maintained in storage facilities such as storage tank 29. A high oil content petroleum sludge is withdrawn from storage tank 29 and, optionally, is dewatered by dewatering unit 30 e.g. heat exchanger followed by a flash drum and fed to slurry drum 31 where it is mixed with a petroleum stream, such as a gas oil fed through conduit 32 to reslurry the high oil content petroleum sludge which is then introduced through conduit 33 and three way valve 34, to the inlets of coke drums 16, 17. The sludge may be heated in a separate heater prior to injection into the drum or, alternatively the feed may be heated to a higher temperature in the furnace to supply sufficient heat to ensure satisfactory coking. The high oil content petroleum sludge is fed to coke drums 16, 17 only during the coking phase of the process.

Sources of high water content petroleum sludges (not shown) discharge into storage tank 35 for temporarily storing the high water content sludge in which is then used as a quench medium in coke drums 16, 17 during the quenching phase of the process. Coke drums 16, 17 may be operated simultaneously although it is preferable to alternate the introduction of delayed coker feed into one drum while coke is removed from the other drum.

Other waste streams may also be introduced separately to the coker drum or mixed with the heavy hydrocarbon coker feed and/or high oil content sludge e.g. catalyst fines, if these may be incorporated into the coke.

Coke recovery proceeds by removal of the top and bottom heads from the drums and cutting of the coke by hydraulic jets. The coke so cut from the drum appears in sizes ranging from large lumps to fine particles. The coke so obtained may have a higher quality (lower content of volatile combustible matter (VCM) than that previously obtainable. If the coke is of appropriate quality it may be calcined or, alternatively, used as fuel grade coke.

The effect of the present recycling process is illustrated by a comparison showing calculated estimates of coke volatile combustible matter (VCM) content which could be obtained by injecting sludges at a relatively high rate of 1.3 bbl of sludge (total) per ton of coke, both with and without segregation. Example 1 below illustrates the effect of injecting sludge without segregation according to water content and Example 2 shows the effect of segregating the sludge according to water content. In Example 2, the results are derived by assuming that the sludge segregation is made to produce two sludges having compositions as follows (weight percent):

| | Water | Oil | Solids |
|---|---|---|---|
| High Oil Sludge | 40 | 50 | 10 |
| High Water Sludge | 88 | 3 | 9 |

The high oil content sludge is then assumed to be subjected to an optional pretreatment step of dewatering and reslurrying with a hydrocarbon stream (CHGO) to a 0/90/10 composition (water/oil/solids, weight percent) followed by preheating prior to injection into the coker. In addition, the VCM content is estimated by assuming that all the oil in the sludge which is injected during the quenching remains on the coke as VCM. The calculated comparisons are shown in Table 2 below.

TABLE 2

| Comparative Example 1 (Without Segregation) | Sludge Volume (bbl/ton coke) | Sludge Composition (Wt %) | | | Coke VCM Inc. (Wt %) |
|---|---|---|---|---|---|
| | | Water | Oil | Solids | |
| During Quench | 1.3 | 65 | 25 | 10 | 5.8 |
| During Coking | — | — | — | — | — |
| Total | 1.3 | 66 | 25 | 10 | 5.8 |
| Example 2 With Segregation | | | | | |
| During quench | 0.7 | 88 | 3 | 9 | 0.4 |
| During Coking | 0.6 | 0 | 90 | 10 | 0 |
| Total | 1.3 | | | | 0.4 |

As shown in Table 2, the injection of sludge during the quench cycle (Example 1) results in a relatively high coke VCM content which is significantly reduced if the sludge is segregated and injected according to water content during the two portions of the coking cycle (Example 2). For this reason, the amount of sludge which may be injected without segregation during the quench portion of the cycle may require to be limited to lower values in actual, commercial operations. However, by segregating the sludges and injecting the high oil content sludges during the coking phase of the cycle, reltively higher amounts of sludge can be recycled, as shown by Example 2.

We claim:

1. A process for recycling of petroleum containing sludge comprising:

(a) segregating waste oil-containing sludges into a relatively high oil content sludge and a relatively high water content sludge;

(b) introducing the high oil content sludge into a delayed coking drum under delayed coking conditions in the presence of a liquid coker hydrocarbon feedstock to form coke;

(c) introducing the high water content sludge into a delayed coking drum to quench the coke formed in the coking drum.

2. The process of claim 1, in which the high oil content sludge is mixed with the hydrocarbon feedstock prior to introduction into the delayed coking drum.

3. The process of claim 1, in which the high oil content sludge contains less than 70% by weight of water.

4. The process of claim 1, in which the high water content sludge contains at least 70% by weight of water.

5. The process of claim 1, in which the high oil content sludge is preheated prior to introduction into the delayed coking drum.

6. The process of claim 1, in which the delayed coking conditions include a coking temperature of from about 700° F. to about 1100° F.

7. The process of claim 1, in which the high oil content sludge comprises slop oil emulsion solids, API separator skimmings, storage tank bottoms or mixtures of these.

8. The process of claim 1, in which the high water content sludge is a biosludge or DAF float sludge or a mixture of these.

9. The process of claim 1, in which steam is introduced intermediate steps (b) and (c) to strip volatiles in the coker drum.

10. In a process for recycling petroleum refinery sludges in a delayed coker by introducing a liquid hydrocarbon feedstock into a delayed coking drum under delayed coking conditions to produce delayed coke in the drum and quenching the coke produced in the drum, the improvement comprising obtaining a refinery sludge source of a relatively high oil content and a refinery sludge source of relatively low oil content by segregating petroleum refinery sludges, adding the petroleum sludge of relatively high oil content to the coker feedstock introduced into the delayed coking drum and subjecting the petroleum sludge of relatively high oil content and the coker feedstock to delayed coking conditions in the coking drum and quenching the coke in the drum with the sludge of relatively high water content.

11. The process according to claim 10 in which the high oil content sludge contains at least 30 weight percent oil.

12. A process according to claim 10 in which the high water content sludge contains at least 70 percent water.

13. A process according to claim 10 in which the high oil content sludge contains at least 50 weight percent oil.

* * * * *